US008434731B2

(12) United States Patent
Everitt et al.

(10) Patent No.: US 8,434,731 B2
(45) Date of Patent: May 7, 2013

(54) STRUCTURAL SUPPORT

(75) Inventors: Anthony Everitt, Birmingham (GB); Darren Copeland, Birmingham (GB)

(73) Assignee: Varley and Gulliver Limited, Birmingham, West Midlands (GB)

( * ) Notice: Subject to any disclaimer, the term of this patent is extended or adjusted under 35 U.S.C. 154(b) by 370 days.

(21) Appl. No.: 12/744,051

(22) PCT Filed: Nov. 18, 2008

(86) PCT No.: PCT/GB2008/003880

§ 371 (c)(1), (2), (4) Date: May 20, 2010

(87) PCT Pub. No.: WO2009/066065

PCT Pub. Date: May 28, 2009

(65) Prior Publication Data

US 2010/0263249 A1 Oct. 21, 2010

(30) Foreign Application Priority Data

Nov. 24, 2007 (GB) ..... 0723056.8
Jul. 18, 2008 (GB) ..... 0813145.0

(51) Int. Cl.
*F16M 13/00* (2006.01)

(52) U.S. Cl.
USPC ..... 248/548; 248/519; 248/900

(58) Field of Classification Search ..... 248/548, 248/511, 900, 345.1, 519, 539; 40/607.5
See application file for complete search history.

(56) References Cited

U.S. PATENT DOCUMENTS

| | | | | |
|---|---|---|---|---|
| 3,847,334 | A | 11/1974 | Forsberg et al. | |
| 4,759,161 | A | 7/1988 | Kucyk, Jr. et al. | |
| 7,770,861 | B2 * | 8/2010 | Huxtable et al. | 248/345.1 |
| 2006/0208149 | A1 * | 9/2006 | Hall et al. | 248/511 |

FOREIGN PATENT DOCUMENTS

| | | | |
|---|---|---|---|
| DE | 2926414 | | 1/1981 |
| EP | 0144816 | | 6/1985 |
| EP | 0414284 | | 2/1991 |
| EP | 1479968 | A2 | 11/2004 |
| FR | 2888271 | | 1/2007 |
| GB | 2174431 | | 11/1986 |
| JP | 11223051 | | 8/1999 |
| WO | WO 95/14146 | | 5/1995 |
| WO | PCT/GB2008/003880 | * | 5/2009 |

* cited by examiner

*Primary Examiner* — Bradley Duckworth
(74) *Attorney, Agent, or Firm* — Wells St. John P.S.

(57) ABSTRACT

The invention relates to a support structure for use in supporting a road sign or the like. A longitudinal tubular support member has a uniform cross-section that includes a plurality of circular or part-circular port sections for receiving an end anchorage. Enclosing wall sections extend between the port sections and are shaped to include a concave form so as to promote inward collapsing of the support member in the event of an impact to the support structure.

25 Claims, 5 Drawing Sheets

STRUCTURAL SUPPORT

CROSS REFERENCE TO RELATED APPLICATION

This application is a 35 U.S.C. §371 of and claims priority to PCT International Application Number PCT/GB2008/003880 (Publication No. WO 2009/066065A2), which was filed 18 Nov. 2008 (18.11.08), and was published in English, and this application claims priority to UK Patent Application No. 0813145.0 which was filed 18 Jul. 2008 (18.07.08), and this application claims priority to UK Patent Application No. 0723056.8 which was filed 24 Nov. 2007 (24.11.07) and the teachings of which are incorporated herein by reference.

The present invention relates to a structural support. More particularly the invention relates to a support for use in roadside applications, such as for supporting road signs or the like, and to means for anchoring such supports to the ground.

Conventional roadside structures may consist of one or more vertical supports made from lengths of round or square section tube. The supports are anchored at one end to the ground, and support a road sign or the like at an elevated position. These supports are low cost and easy to construct, but suffer from a number of drawbacks.

One problem arises with the use of support structures in roadside applications where there is a possibility of an errant vehicle striking the structure or in the event of an accident. In that case, it is desirable for the support structure to absorb the impact in a manner that results in minimizing the risk of harm to the occupants, or to nearby pedestrians. European standard EN 12767 defines three categories of structure: non-energy absorbing (NE); low-energy absorbing (LE); and high-energy absorbing (HE). These categories are defined by the reduction in exit speed of a vehicle after impact with the structure. The higher the exit speed the lower (or no) energy is absorbed, while the lower the exit speed the higher the energy absorbed. Most support systems, including most tubular road sign supports, are categorised as NE. However, particularly for taller structures, and for use in urban areas, HE, or at least LE structures would be preferable to help protect pedestrians or other road users.

Another problem with known support structures arises with longevity of use. Fatigue cracks may appear in a structure. Fatigue cracks arise from repetitive loading, and this may be a particularly acute problem where a support structure is subjected to wind loading, as is likely to occur in many road sign locations.

It is an object of the present invention to provide a support structure that alleviates the aforementioned problems.

According to a first aspect of the present invention there is provided support structure for use in supporting a road sign or the like, and comprising a longitudinal tubular support member having a uniform cross-section that comprises: a plurality of circular or part-circular port sections for receiving an end anchorage; and enclosing wall sections extending between said port sections and shaped to include a concave form so as to promote inward collapsing of the support member in the event of an impact to the support structure.

In embodiments of the invention, the concave form comprises an inwardly-directed bend in the enclosing wall sections. The enclosing wall sections may include a double, or zigzag bend, or may have a shallow V-shaped cross section, or a W-shaped cross-section. Advantageously, the support member is configured to deform in an eccentric manner in the event of an impact.

It is an advantage that the concave form of the wall sections promotes inward collapsing of the support member in the event of an impact thereby reducing the stiffness of the support member, which in turn will reduce the forces on the vehicle and occupants. Also, because the form of the wall sections promotes local collapse of the support member, as opposed to fracture, the likelihood is of a higher level of energy absorption, which is beneficial.

Embodiments may further comprise keyway channels formed along the outside of the support member. The keyways may be used to receive a key on the edge of a sign board, or other component to be supported.

In embodiments of the invention, the port sections are circular or part-circular in cross-section. The port sections may be spaced apart at extremities around the cross section of the structure. The port sections may be arranged as a plurality of pairs around the cross-section of the support member. The port sections may be only partly enclosed, having openings directed inwardly of the structure. It is an advantage that the openings allow for an anchorage received in the port section to be forced out of the port section in the event of an impact from one side of the support structure, but to be retained within the port section when the impact is from a different direction.

In embodiments of the invention, the support member is an extrusion, and may be formed of a metal such as aluminium or its alloys.

In embodiments of the invention the cross-section of the support member has a shape that includes external features that will disrupt vortex-shedding thus reducing vibration of the structure and the tendency for fatigue. Preferably, the cross-section is symmetrical.

In embodiments of the invention, the support structure further comprises an anchoring arrangement anchoring the support structure to a base.

In embodiments of the invention a cut-out may be formed in the tubular support member between adjacent ports, the cut-out extending longitudinally from the end. Preferably, the cut-out extends for a width between adjacent ports and for a longitudinal distance from the end, said width and longitudinal distance being determined to provide a frictional resistance in the event of a predetermined impact force on said structure, which frictional resistance is insufficient to prevent shearing of at least one of said anchoring fasteners.

According to a second aspect of the present invention there is provided a structural support anchoring system for anchoring a longitudinal member having a port section with an opening at one end of the longitudinal member for receiving an anchorage, the anchorage comprising: a sleeve member engageably received in the port section, the sleeve member having an extended inward end portion sized to provide a close fit inside the port section and a tapered bore; and an anchoring bolt received in the sleeve member.

The port section may have an internal thread for engaging a corresponding external thread on the sleeve member. The internal thread may extend for a predetermined length and include a gradually reducing tapered thread portion.

It is an advantage that tapered bore in the end portion of the sleeve member reduces the stress concentration in the longitudinal member that can arise from a transverse loading, such as a wind loading. The tapered thread portion also helps to reduce the stress concentration at this position. Reduced stress concentration helps to reduce fatigue. It is a further advantage that the use of a sleeve allows for different sizes of anchoring bolt to be used, and the bolt size can be selected so that a failure in the support structure caused by an impact will be more likely to occur in the bolt rather than in the longitudinal support member.

In embodiments of the invention, the structural support anchoring system comprises a plurality of port sections for receiving respective anchoring fasteners, the ports being arranged around and adjacent to a circumference of the support member and extending longitudinally from the end; and a cut-out formed in the tubular support member between adjacent ports, the cut-out extending longitudinally from the end. Preferably, the cut-out extends for a width between adjacent ports and for a longitudinal distance from the end, the width and longitudinal distance being determined to provide a frictional resistance in the event of a predetermined impact force on the structure, which frictional resistance is insufficient to prevent shearing of at least one of the anchoring fasteners.

According to a third aspect of the present invention there is provided a support structure for use in supporting a road sign or the like, and comprising a longitudinal tubular support member an end of which is arranged to form an anchorage for the support structure, wherein the anchorage comprises: a plurality of ports for receiving respective anchoring fasteners, the ports being arranged around and adjacent to a circumference of the support member and extending longitudinally from the end; and a cut-out formed in the tubular support member between adjacent ports, the cut-out extending longitudinally from the end.

The cut-out preferably extends for a width between adjacent ports and for a longitudinal distance from the end, the width and longitudinal distance being determined to provide a frictional resistance in the event of a predetermined impact force on said structure, which frictional resistance is insufficient to prevent shearing of at least one of said anchoring fasteners.

Embodiments of the invention will be described with reference to the accompanying drawings in which.

Figure 1:
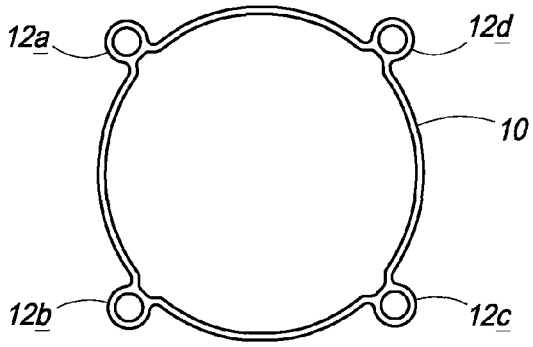
PRIOR ART FIG. 1
FIG. 1 is a cross-section through a structural support member having a circular tubular form.

A support structure of the type used for supporting road signs or the like includes a longitudinal tubular support member 10 having the cross-section shown in FIG. 1. This type of support member is most commonly employed in a vertical configuration, being anchored at one end to the ground at a roadside. The cross-section of the tubular support member 10 is generally circular, but also includes four equi-spaced circular port sections 12*a-d*. These port sections are used to receive anchorages at one end (usually at the ground) in a manner that will be described in more detail later.

A problem with the structural support member of FIG. 1 can arise if a vehicle impacts the structure in a road accident. The structure will deform around the impact location, such that the cross-section of the support member becomes distorted. When the structural support member 10 is struck, the impact force is transmitted around the tube walls. The curvature of the tube walls means that as the tube wall immediately in front of the impact is pushed inwards (towards the central axis), the walls at each side are forced outwards such that the cross-section becomes generally oval or flattened. This is a relatively low-energy deformation, which means that a relatively small amount of the impact energy is absorbed by the structure. As a consequence, support structures of this type tend to be NE or LE structures (as defined in EN 12767). Of course, one way to make such circular cross-section members absorb more energy is to make the tube wall thicker, but this increases the weight of the structure and is wasteful of material.

Figure 2:
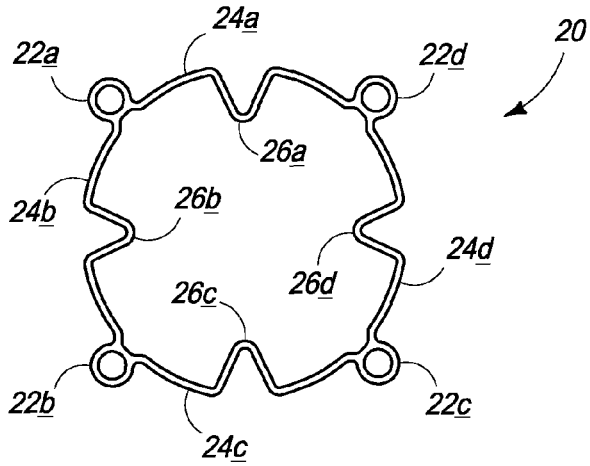
FIG. 2 is a cross-section through a structural support member in accordance with a first embodiment.

FIG. 2 illustrates a cross-section through a structural support member 20 of a first embodiment utilizing the principles of the invention. Again there are four circular port sections 22*a-d* spaced around a tubular configuration, and four segments 24*a-d* of tube wall between each port section. Approximately mid-way along each segment 24*a-d* is an inwardly-directed bend 26*a-c*. These are concave bends (when viewed from outside the structure). These concave bends 26*a-c* each form a location of preferential deformation so that when the structure is impacted (e.g. by a vehicle) the tubular support member will tend to deform inwardly. For example, if a vehicle impacts the structural support member 20 in a direction from the left side as shown in FIG. 2, it will strike the wall segment 24*b*. As the wall segment 24*b* is pushed to the right, the concave bend 26*b* will fold in on itself, drawing the adjacent parts of wall segments 24*a* and 24*d* inwards. Also, the concave bends 26*a* and 26*c* will tend to fold inwards under the impact so that the entire leftside of the structure collapses into the right side. This inward deformation of the structural support member 20 absorbs more energy than the deformation of a structural support member such as that shown in FIG. 1 having the same overall dimensions and wall thickness.

Figure 3:
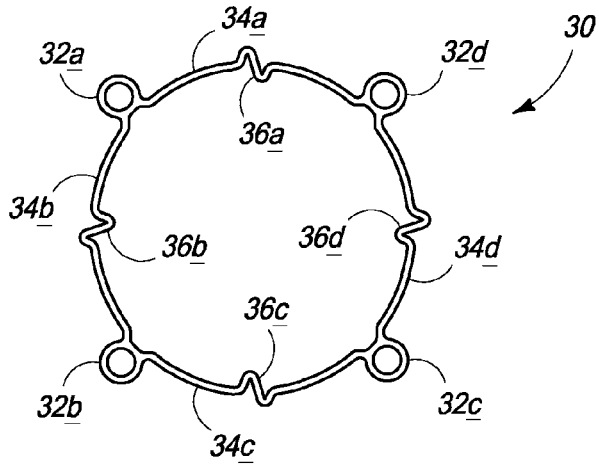
FIG. 3 is a cross-section through a structural support member in accordance with a second embodiment.

An alternative structural support member 30 is shown in FIG. 3. Here, each of the segments 34*a-d* has a double, or zigzag bend 36*a-d* approximately mid-way between port sections 32*a-d*. The inner bend of each zigzag is a concave bend that will tend to promote inward deformation under an impact. However, in this case the double zigzag bends will tend to fold up under an impact, such that one half of each wall segment 34*a-d* will overlap the other half, resulting in a reduction in the overall circumference of the tubular support member 30. Again, the energy absorbed by this type of deformation is significantly greater than with the structural support member of FIG. 1.

It will be appreciated that each of the cross-sections of the structural support members 10, 20, 30 in FIGS. 1 to 3 can readily be formed by extrusion. Typically, such structures will be formed of a metal such as aluminium or its alloys.

Figure 4:
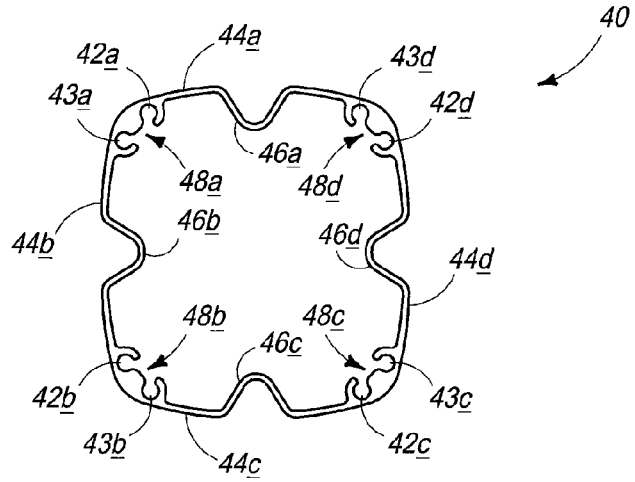
FIG. 4 is a cross-section through a structural support member in accordance with a third embodiment.
Figure 5:
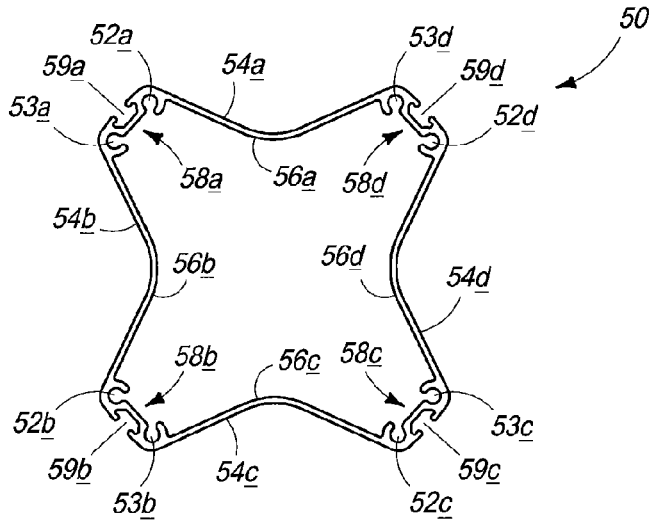
FIG. 5 is a cross-section through a structural support member in accordance with a fourth embodiment.
Figure 6:
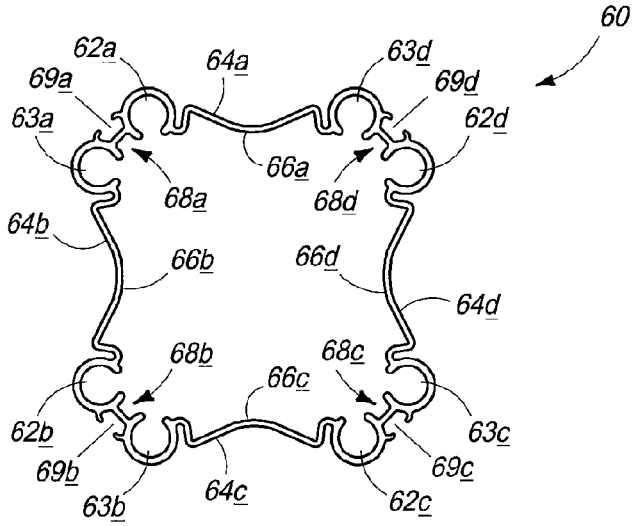
FIG. 6 is a cross-section through a support structure in accordance with a fifth embodiment.

Each of the structures shown in FIGS. 1 to 3 has four port sections 12*a-d*, 22*a-d*, 32*a-d*. It will be appreciated that more or fewer port sections could be provided without departing from the general principles described above. Also, each of the port sections 12*a-d*, 22*a-d*, 32*a-d* forms an enclosed circle, and is located outside the diameter of the tube. This is because it is preferable for the anchorage points to be spread apart as far as possible without increasing the overall diameter of the tubular support members (which would be wasteful of material). FIGS. 4 to 6 show structural support members having a different port section arrangement.

In FIG. 4, the circular cross-section tubular structural support members of FIGS. 1 to 3, are replaced with a more square-like cross-section in a structural support member 40. In this case there are eight port sections arranged as four pairs of port sections 42*a*, 43*a*; 42*b*, 43*b*; 42*c*, 43*c*; 42*d*, 43*d*; one at each corner of the cross-section. Each of the port sections 42*a*-43*d* are only partly enclosed, and have openings 48*a*-48*d*, directed generally inwardly towards the tube axis. The reasons for this will be explained further below. The structural support member 40 is otherwise similar to the structural support member 20 of FIG. 2 and includes four segments 44*a-d* of tube wall between each pair of port sections as well as inwardly-directed concave bends 46*a-c* mid-way along each wall segment 24*a-d*.

The structural support member 50 of FIG. 5 is similar to that of FIG. 4, except that it has wall segments 54*a-d* that have a shallow V-shaped cross section, with inwardly-directed concave bends 56*a-c* mid-way along each segment 24*a-d*. The structural support member 50 includes pairs of port sections 52*a-d*, 53*a-d* following the same or similar form to the port sections 42*a-d*, 43*a-d* of the structural support member 40 shown in FIG. 4. The structural support member 50 also includes keyway channels 59*a-d* along the outside of each of the corner sections adjacent to the port sections 52*a-d*, 53*a-d*. These keyway channels 59*a-d* may be used to engage corresponding keys on sign boards or other articles that are to be mounted to the support structure.

FIG. 6 shows a cross-section of a structural support member 60, similar to the structural support member 50 of FIG. 5. The structural support member 60 has wall segments 64*a-d* that have a shallow V-shaped cross section, with inwardly-directed concave bends 66*a-c* mid-way along each segment 24*a-d*. The structural support member 60 includes pairs of port sections 62*a-d*, 63*a-d* but these are of a significantly larger diameter than the port sections of the structural support members 40, 50 shown in FIGS. 4 and 5. As a consequence the wall segments 64*a-d* are significantly narrower. Also, the wall segments 64*a-d* have a W-shaped cross-section, with the concave bends 66*a-d* at the centre. In this arrangement, the port sections 62*a-d*, 63*a-d* provide a significantly greater proportion of the support and load-bearing capacity compared with the port sections of the previously described embodiments. Also, the W-shaped cross-section of the wall segments 64*a-d* provides multiple (in this case 3) concave bends that promote inward deformation of the structure under an impact. The structural support member 60 also includes keyway channels 69*a-d* along the outside of each of the corner sections adjacent to the port sections 62*a-d*, 63*a-d*.

Figure 7:
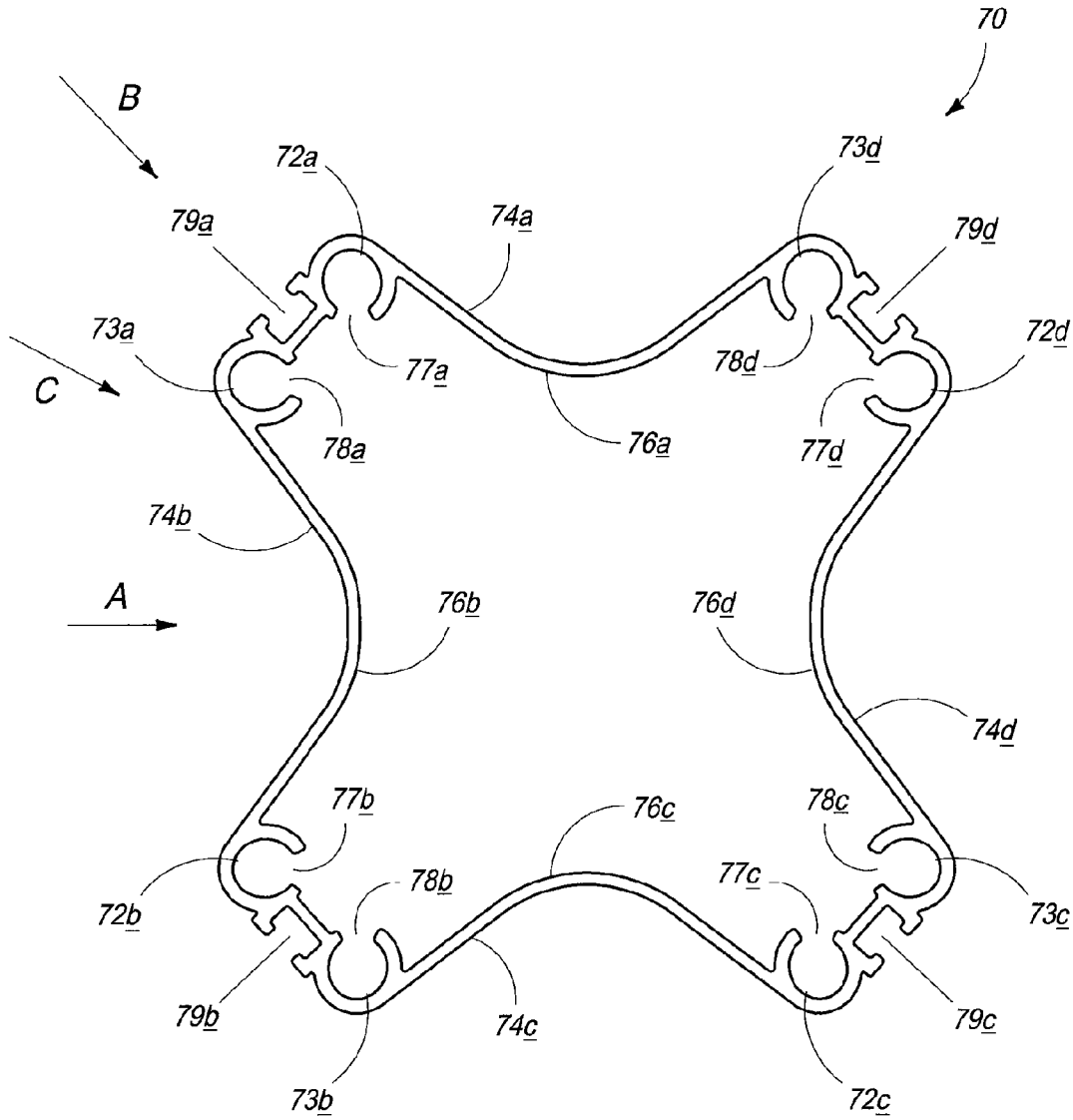
FIG. 7 is a cross-section through a support structure in accordance with a sixth embodiment.

FIG. 7 shows a cross-section through a structural support member 70, which includes features similar to those shown in FIGS. 5 and 6. The structural support member 70 has wall segments 74*a-d* with inwardly-directed concave bends 76*a-c*. The structural support member 70 includes pairs of port sections 72*a-d*, 73*a-d*, with respective inward openings 77*a-d*, 78*a-d*. The structural support member 70 also includes keyway channels 79*a-d* along the outside of each of the corner sections adjacent to the port sections 72*a-d*, 73*a-d*.

The structural support members shown in FIGS. 4 to 7, and most particularly the structural support member 70 of FIG. 7, have particular advantages with regard to how they deform under an impact. Consider first an impact in the direction of arrow A in FIG. 7. In this case a vehicle striking the structure will make contact simultaneously with the outer wall of the port sections 73*a* and 72*b*. In that case, the entire left-hand side of the cross-section (as shown in FIG. 7) will be pushed to the right by the impact. The concave bends 76*a*, 76*c* in the wall segments 74*a*, 74*c* will tend to fold in and the entire left hand side will collapse towards the right-hand side. Consider next an impact in the direction of arrow B. Here the vehicle will impact the structural support member 70 at the corner defined by the port sections 72*a* and 73*a*. In this case, the concave bends 76*a* and 76*b* in the wall segments 74*a* and 74*b* will bend inwards under the impact and the port sections 72*a*, 72*b* will deform by being pushed in towards the axis of the structure.

It will be appreciated that, in general, the impact from a vehicle is unlikely to strike the structural support member 70 directly in the direction of either of arrows A or B, but will most likely be at some other intermediate angle, such as in the direction of arrow C. Here, the vehicle will impact the outside of port section 73*a*. As a result, the concave bend 76*a* in wall segment 74*a* will deform by folding in. However, due to the angle of the impact the concave bend 76*b* in wall segment 74*b* may or may not fold, but the degree of folding in will be less than that of concave bend 76*a* in wall segment 74*a*. A consequence of this is that the entire structural support member 70 will tend to deform in an eccentric manner (i.e. by twisting of at least part of the cross-section). This eccentric deformation is particularly beneficial for absorbing the energy of the impact.

When a structural support member 40, 50, 60, 70, is subjected to an impact, the impact is absorbed as described above, but the structure will, in general, be stiffer closer to the anchorage points that hold the structural support member to the ground. This may, or may not have a beneficial effect (from the point of view of absorbing a desired amount of energy from the impact), but the cross-sections of the structural support members 40, 50, 60, 70 are designed to enable them to be erected and anchored in such a way that the desired amount of impact energy is absorbed.

Firstly, each of the structural support members 40, 50, 60, 70 in FIGS. 4 to 7 includes port sections arranged in pairs. This means that either one or two anchorage fixings can be employed at each corner and the number of fixings is selected according to the required energy absorption criteria. A more detailed discussion of anchorage fixings according to an embodiment of the invention is set out below with reference to FIG. 8.

Secondly, each of the structural support members 40, 50, 60, 70 in FIGS. 4 to 7 include port sections 42*a-d*, 43*a-d*, 52*a-d*, 53*a-d*, 62*a-d*, 63*a-d*, 72*a-d*, 73*a-d*, that have inwardly directed openings 48*a-d*, 58*a-d*, 68*a-d*, 77*a-d*, 78*a-d*. These openings are longitudinal slots that extend the entire length of the structure, and are provided so that the anchorage fixings are not completely surrounded by the port section. This means that when the anchorage fixing is on the side of the structure that is struck, the fixing will remain inside the port section, but when it is on the opposite side, if the impact is great enough, the anchorage fixing will be forced out of the port section through the opening. This forcing out of the anchorage fixings allows for more precise control of the energy absorbed in an impact.

A further advantage arises from the shape of the cross sections of the structural support members of the invention, and particularly the embodiments shown in FIGS. 5 to 7. This is the effect that the cross-section has on the wind loading. The features of the cross-sections shown help to disrupt vortex-shedding, especially at the corners where the port sections are located. This disruption of vortex-shedding reduces vibration of the structural support member, which in turn reduces the tendency for fatigue.

It will be appreciated that each of the cross-sections of the structures 40, 50, 60, 70 in FIGS. 4 to 7 can readily be formed by extrusion. Typically, such structures will be formed of a metal such as aluminium or its alloys. Also, each of the structures shown in FIGS. 4 to 7 has four port sections 12*a-d*, 22*a-d*, 32*a-d*. It will be appreciated that more or fewer port sections could be provided without departing from the general principles of the invention. However, a symmetrical arrangement is particularly beneficial because it provides substantially equivalent performance whatever the orientation of the structure.

Figure 8:
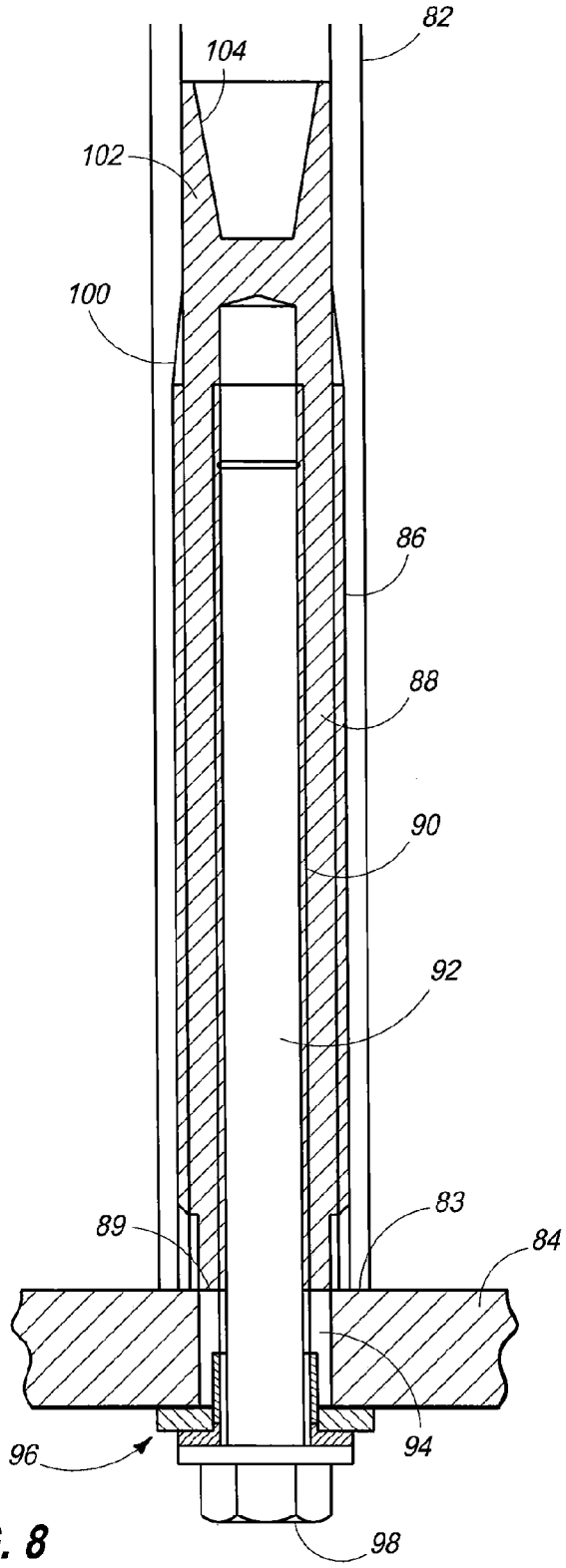
FIG. 8 is a sectional side elevation of a system for anchoring the structural support member of any of FIGS. 1 to 7.

FIG. 8 shows an anchorage arrangement for anchoring a support structure as shown in any of FIGS. 1 to 7. The anchorage extends into a port section 82, so as to anchor it to a base plate 84. The port section 82 has an internal thread 86 extending for a predetermined length from an end 83 where it abuts the base plate 84. A sleeve 88 has a corresponding external thread and is screwed all the way into the port section 82, such that an end face 89 of the sleeve 88 is flush with the end 83 of the port section 82. The sleeve 88 has an internally threaded bore 90, which receives an anchoring bolt 92. The anchoring bolt 92 passes through a hole 94 in the base plate 84 with an arrangement of washers 96 between the base plate 84 and a bolt head 98. The anchoring bolt 92 extends most of the way along the threaded bore 90 in the sleeve 88.

The external thread on the sleeve 88 extends almost to the end of the predetermined length of the internal thread 86 in the port section 82. However, this internal thread 86 extends beyond the end of the threaded length of the sleeve 88 with a gradually reducing tapered thread 100. The sleeve 88 has an unthreaded inward end portion 102, which extends further into the port section 82 past the tapered thread 100. This unthreaded inward end portion 102 has a diameter sized to provide a close fit with the unthreaded internal bore of the port section 82. The inward end portion 102 includes a tapered internal bore 104 extending from the internal end of the sleeve 88. The taper of the internal bore 104 means that the wall thickness of the inward end portion 102 reduces towards the internal end of the sleeve 88.

The use of the sleeve 88 allows for different sized bolts 92 to be used in different circumstances. It is generally preferable, in an impact situation, for the support structure to fail by failure of the bolt 92, rather than a failure in the structural support member itself. Thus, the size of the bolt 92 can be selected to ensure that this is more likely to occur in a given application by using a sleeve 88 having a correspondingly sized internally threaded bore 90.

The sleeve 88 is also reduces the effects of repetitive loadings applied to the support structure—for example wind loadings on a road sign supported by the structure. Anchorage points are particularly susceptible to fatigue failure caused by such repetitive loadings, because features of the anchorage give rise to locations where stress concentrations occur and fatigue cracks are initiated. In the anchorage shown in FIG. 8, the tapered thread 100 reduces the chances of fatigue cracks being initiated at the end of the thread, while the tapered wall of the inward end portion 102 help to reduce stress concentrations at the ends of the sleeve 88. In addition, the presence of the sleeve 88 presents two interfaces, one between the port section 82 and the sleeve 88, and the other between the sleeve 88 and the anchoring bolt 92. These interfaces are effective in stopping fatigue cracks from propagating any further through the structure. In addition, suitable adhesive materials can be used between the threads to improve the resistance to fatigue.

Figure 9:
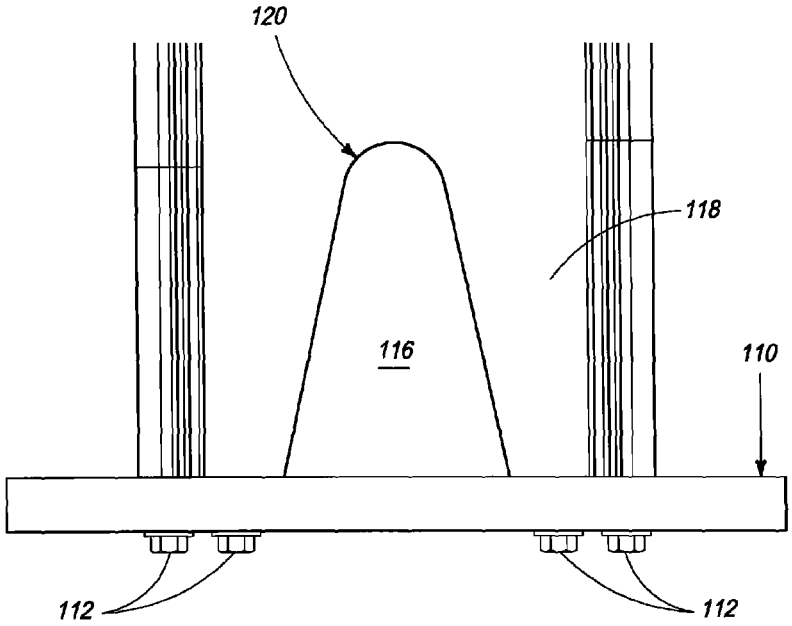
FIG. 9 is a side elevation of an anchorage and a base portion of the structural support member of FIG. 7.

FIG. 9 illustrates a side elevation showing a base plate 110 and a bottom end portion of the structural support member 70 shown in FIG. 7 (although the principles described hereafter may also be used with a member of any suitable cross-section, such as those shown in FIGS. 1 to 6). The heads 112 of anchoring bolts can be seen on the underside of the base plate 110, and these bolts extend upwards for a distance inside ports in the cross-section of the member 70, as described above with reference to FIG. 8. A cut-out 116 is formed in a wall 118 of the support member 70, extending upwards from the base plate. The cut-out 116 is formed in the wall 118 between adjacent pairs of ports, The cut-out 116 extends upwards to a height above the base plate and laterally for a width between the adjacent anchorage ports. So as to maintain strength and rigidity of the support member, the cut-out 116 tapers from the base plate towards a radiussed top-end 120. the top-end radius means that the cut-out 116 can be formed without any sharp corners that might otherwise give rise to stress concentrations where fatigue cracks could be initiated.

The presence of the cut-out 116 reduces the contact area between the bottom end of the support member 70 and the base plate 110. This means that, in the event of a sideways impact to the structure, there is less frictional resistance to movement. It has been found that, depending on the size and type of structure (NE, LE etc.) the frictional resistance can have a significant effect on the amount of impact energy absorbed. In particular, for larger sizes of structure (i.e. larger cross-section members) where it is desired for at least one of the anchorage bolts to shear in the event of an impact, then the presence of the cut-out reduces the frictional resistance between the member and the base plate to the point where it is insufficient to prevent shearing. However, it will be appreciated that the amount of frictional resistance will vary depending on the size of the structural support member cross-section. Thus, it may be that the use of cut-outs as described above are preferred fro large structures, while for medium structures the cut-outs are not required, but the use of 8 fixing bolts is required in the anchorage and for small structures only 4 fixing bolts are required.

As will be apparent from the above, there are various criteria that may be used when determining the particular method used to anchor a sign support. These include: road speed, size of signage, placement of sign, ground conditions and whether the sign support is passive or not. A passive support is one that is not considered to present a significant hazard or danger to people (passengers or pedestrians) if the sign is impacted by an errant vehicle. Most of the sign supports in use today, if protected by safety barrier, are not passive supports and are usually buried in the ground or concrete foundation. Where there is no safety barrier protection and the supports are buried in the ground they are either small posts, which are deemed to be passive, or there is a connections plate similar to that described above and shown in FIG. 8, which is also buried. The anchorage embodiments described above are particularly suitable for sign supports that are not passive. However, the structural supports shown in FIGS. 1 to 7 are suitable for use on either passive or non-passive supports.

The invention claimed is:

1. A support structure comprising a longitudinal tubular support member having a uniform cross-section that comprises:

a plurality of port sections for receiving end anchorages; and a plurality of wall sections, each wall section extending between a pair of said port sections, each of said wall sections being shaped to include an inwardly-directed bend so as to promote inward collapsing of the support member in the event of an impact to the support structure, wherein the port sections are spaced apart at extremities around the cross-section and are disposed outwardly of said wall sections.

2. The support structure of claim 1 wherein the wall sections include a double, or zigzag bend.

3. The support structure of claim 1 wherein the wall sections have a shallow V-shaped cross section.

4. The support structure of claim 1 wherein the wall sections have a W-shaped cross-section.

5. The support structure of claim 1 wherein the support member is configured to deform in an eccentric manner in the event of an impact.

6. The support structure of claim 1 further comprising keyway channels formed along the outside of the support member.

7. The support structure of claim 1 wherein the port sections are circular or part-circular in cross-section.

8. The support structure of claim 1 comprising four port sections spaced around the tubular support member.

9. The support structure of claim 1 wherein the port sections are arranged as a plurality of pairs around the cross-section of the support member.

10. The support structure of claim 1 wherein the port sections are only partly enclosed, having openings directed inwardly of the structure.

11. The support structure of claim 1 formed as an extrusion.

12. The support structure of claim 1 formed of a metal such as aluminum or its alloys.

13. The support structure of claim 1 wherein the cross-section is symmetrical.

14. The support structure of claim 1 wherein the cross-section of the support member has a shape that includes external features that disrupt vortex-shedding.

15. The support structure of claim 1 further comprising an anchoring arrangement anchoring the support structure to a base, wherein the anchoring arrangement comprises one or more anchoring members extending longitudinally into a respective port section.

16. The support structure of claim 15 wherein the anchoring member comprises an anchoring bolt.

17. The support structure of claim 16 further comprising a sleeve engageably received in the port section.

18. The support structure of claim 15, further comprising a cut-out formed in the tubular support member between adjacent ports, the cut-out extending longitudinally from the end.

19. The support structure of claim 18 wherein the cut-out extends for a width between adjacent ports and for a longitudinal distance from the end, said width and longitudinal distance being determined to provide a frictional resistance in the event of a predetermined impact force on said structure, which frictional resistance is insufficient to prevent shearing of at least one of said anchoring fasteners.

20. A structural support anchoring system for anchoring a longitudinal member, wherein at least an end portion of the longitudinal member has a port section with an opening at the end of the longitudinal member, the anchoring system comprising:

a sleeve member for engaging the longitudinal member by insertion into the port section through said opening, the sleeve member having an inward, an outward end and a bore; and an anchoring bolt, wherein the anchoring bolt is engageable in the bore of the sleeve member through the outward end, and, in an inward end portion of the sleeve member, the bore has a taper wherein the wall thickness of the sleeve reduces towards the inward end of the sleeve member.

21. The structural support anchoring system of claim 20 wherein the port section has an internal thread for engaging a corresponding external thread on the sleeve member.

22. The structural support anchoring system of claim 20 wherein the bore of the sleeve member has an internal thread for receiving the anchoring bolt.

23. The structural support anchoring system of claim 20 further comprising an adhesive material between engaging threads.

24. The structural support anchoring system of claim 20, comprising a plurality of said port sections for receiving respective anchoring fasteners, the ports being arranged around and adjacent to a circumference of the support member and extending longitudinally from the end; and a cut-out formed in the tubular support member between adjacent ports, the cut-out extending longitudinally from the end.

25. The support structure of claim 24 wherein the cut-out extends for a width between adjacent ports and for a longitudinal distance from the end, said width and longitudinal distance being determined to provide a frictional resistance in the event of a predetermined impact force on said structure, which frictional resistance is insufficient to prevent shearing of at least one of said anchoring fasteners.

* * * * *